US007358947B2

(12) United States Patent
Lee et al.

(10) Patent No.: US 7,358,947 B2
(45) Date of Patent: Apr. 15, 2008

(54) LIQUID CRYSTAL DISPLAY HAVING GRAY VOLTAGES AND DRIVING APPARATUS AND METHOD THEREOF

(75) Inventors: Seung-Woo Lee, Seoul (KR); Young-Ki Kim, Kyungsangbuk-do (KR)

(73) Assignee: Samsung Electronics Co. Ltd., Gyeonggi-Do (KR)

( * ) Notice: Subject to any disclaimer, the term of this patent is extended or adjusted under 35 U.S.C. 154(b) by 562 days.

(21) Appl. No.: 10/738,826

(22) Filed: Dec. 16, 2003

(65) Prior Publication Data

US 2004/0130559 A1 Jul. 8, 2004

(30) Foreign Application Priority Data

Dec. 17, 2002 (KR) ..... 10-2002-0080816

(51) Int. Cl.
*G09G 3/36* (2006.01)

(52) U.S. Cl. ..... 345/89

(58) Field of Classification Search ..... 345/87–89, 345/98

See application file for complete search history.

(56) References Cited

U.S. PATENT DOCUMENTS 6,853,384 B2 * 2/2005 Miyata et al. ..... 345/601

FOREIGN PATENT DOCUMENTS

TW 511050 11/2002

OTHER PUBLICATIONS

English Language Abstract, TW Patent First Publication No. TW511050, Nov. 21, 2002, 1 page.
Search Report, ROC (Taiwan) Patent Application No. 092135799, Mar. 7, 2007, 2 pages.

* cited by examiner

*Primary Examiner*—Amr A. Awad
*Assistant Examiner*—Steven E Holton
(74) *Attorney, Agent, or Firm*—MacPherson Kwok Chen & Heid LLP

(57) ABSTRACT

An apparatus of driving a liquid crystal display (LCD) includes a gray voltage generator generating a range of gray voltages that correspond to different LC light transmittance levels. These gray voltages, along with image data, are fed into a data driver. The data driver converts the gray voltages to a data voltage that properly generates the image indicated by the image data. The gray voltage values are chosen from a wider range of values than the pixel voltages, and this conversion may include determining a conversion factor based on the relative range sizes. This conversion may also include calculating the voltage difference between the previous data and the current data and adjusting the data voltage according to the magnitude of this difference. Generally, the larger the voltage difference, the larger is the data voltage magnitude that is needed to bring the pixel voltage to the target voltage within limited time.

9 Claims, 4 Drawing Sheets

LIQUID CRYSTAL DISPLAY HAVING GRAY VOLTAGES AND DRIVING APPARATUS AND METHOD THEREOF

RELATED APPLICATION

This application claims priority, under 35 USC § 119, from Korean Patent Application No. 2002-0080816 filed on Dec. 17, 2002, the content of which is incorporated herein by reference in its entirety.

BACKGROUND OF THE INVENTION (a) Field of the Invention

The present invention relates to a liquid crystal display having a plurality of gray voltages and driving apparatus and method thereof.

(b) Description of the Related Art

Liquid crystal displays (LCDs) include two panels having pixel electrodes and a common electrode and a liquid crystal (LC) layer with dielectric anisotropy, which is interposed between the two panels. The pixel electrodes are arranged in a matrix and connected to switching elements such as thin film transistors (TFTs), and supplied with data voltages through the switching elements. The common electrode covers the entire surface of one of the two panels and is supplied with a common voltage. The pixel electrode, the common electrode, and the LC layer form an LC capacitor in circuital view, which is a basic element of a pixel along with the switching element connected thereto.

In the LCD, voltages are applied to the two electrodes to generate an electric field in the LC layer, and the transmittance of light passing through the LC layer is adjusted by controlling the strength of the electric field to obtain the desired images. In order to prevent image deterioration that results from a prolonged application of the unidirectional electric field, the polarity of data voltages with respect to the common voltage is reversed for a frame, a row, or a dot.

However, due to the slow response time of LC molecules, it takes time for the voltage of an LC capacitor (referred to as "a pixel voltage" hereinafter) to reach a "target voltage," which is the voltage required for a desired brightness. The amount of time needed to reach the target voltage depends on the difference between the currently applied voltage and the previously applied voltage of the LC capacitor. For example, when the target voltage is applied to the LC capacitor, the pixel voltage may not reach the target voltage while the switching element is turned on, if the difference between the target voltage and the previously applied voltage is large.

Dynamic capacitance compensation (DCC) is a technique that has been used to solve the above problem. The DCC technique utilizes the fact that the charging time becomes shorter as the voltage across the LC capacitor becomes larger. The DCC reduces the amount of time needed by the pixel voltage to reach the target voltage by applying a "data voltage" to a corresponding pixel. A data voltage is typically larger than the target voltage, and is herein used to refer to "the difference between the data voltage and the common voltage" by assuming that the common voltage is zero.

In a conventional gray-scale LCD, a black pixel voltage, which is the pixel voltage applied to the LC capacitor for displaying a black gray (i.e., the lowest gray), and a white pixel voltage, which is the pixel voltage applied to the LC capacitor for displaying a white gray (i.e., the highest gray), determine the upper and lower limits of the data voltages. That is, the data voltages are confined to a range between the black pixel voltage and the white pixel voltage. For example, the black pixel voltage and the white pixel voltage are the minimum and the maximum of the data voltages, respectively, in a normally black LCD (and vice versa in a normally white LCD).

In the normally black LCD, if a current pixel voltage represents a middle gray or a white gray and a target voltage is a black pixel voltage, a voltage smaller than the target voltage should be applied to the pixel voltage to reach the target voltage for a given period. However, it is impossible to apply such a voltage because the lower limit of the data voltage is the target voltage.

Likewise, if a current pixel voltage represents a middle gray or a black gray and a target voltage is a white pixel voltage, a voltage larger than the target voltage should be applied for the pixel voltage to reach the target voltage for a given time. However, it is impossible to apply such a voltage because the upper limit of the data voltage is the target voltage.

As a result, the DCC technique cannot be applied to a white gray or a black gray pixel to improve the charging time of an LC capacitor.

In particular, when displaying motion images with rapid gray changes, the failure to achieve the desired brightness severely deteriorates the image quality. This deterioration is more significant where the gray difference is large, such as when the gray is changed from a white gray to a black gray or vice versa. A method of achieving the desired brightness even when the gray difference is large would dramatically improve image quality in LCD applications.

SUMMARY OF THE INVENTION

A method and apparatus for driving a gray-scale liquid crystal display is provided. To overcome the problem of the pixel voltage not reaching the target voltage when the voltage difference between the previous data and the current data is large, the invention adjusts the data voltage applied to the pixel based on the size of the difference between the previous data and the current data.

In one aspect, the invention is a method of charging an electrode in a display device by selecting a predetermined value, calculating a gray voltage difference between a previous data and a current data, and comparing the gray voltage difference to the predetermined value to determine a pixel voltage, wherein the pixel voltage is selected from a pixel voltage range that is smaller than the gray voltage range.

In another aspect, the invention is a method of displaying an image by receiving image data, modifying the image data using a gray difference between a previous data and a current data to produce modified image data, generating a data voltage by converting the modified image data to a corresponding gray voltage data, wherein the converting includes mapping a range of the modified image data to a range of the gray voltage data, and applying the data voltage to a liquid crystal capacitor made of two electrodes sandwiching a liquid crystal layer.

The invention also includes devices that perform the above methods. For example, the invention includes a display device including a gray voltage generator generating gray voltage data within a gray voltage range, a data driver receiving the gray voltage data and outputting data voltage signals to a plurality of data lines, and a gate driver periodically applying a voltage $V_{on}$ to a gate line to connect the data voltage signals to a liquid crystal capacitor, wherein the data voltage is a value within a data voltage range that is smaller than the gray voltage range.

In another aspect, the invention is a display device that includes a common electrode, a pixel electrode, a liquid crystal layer located between the common electrode and the pixel electrode to form a liquid crystal capacitor, wherein the liquid crystal capacitor receives a data voltage within a first voltage range to generate a moving image and a data voltage within a second voltage range to generate a still image, the first voltage range being greater than the second voltage range.

BRIEF DESCRIPTION OF THE DRAWINGS

The above and other advantages of the present invention will become more apparent by describing several embodiments thereof in detail with reference to the accompanying drawings in which.

DETAILED DESCRIPTION OF PREFERRED EMBODIMENTS

Figure 1:
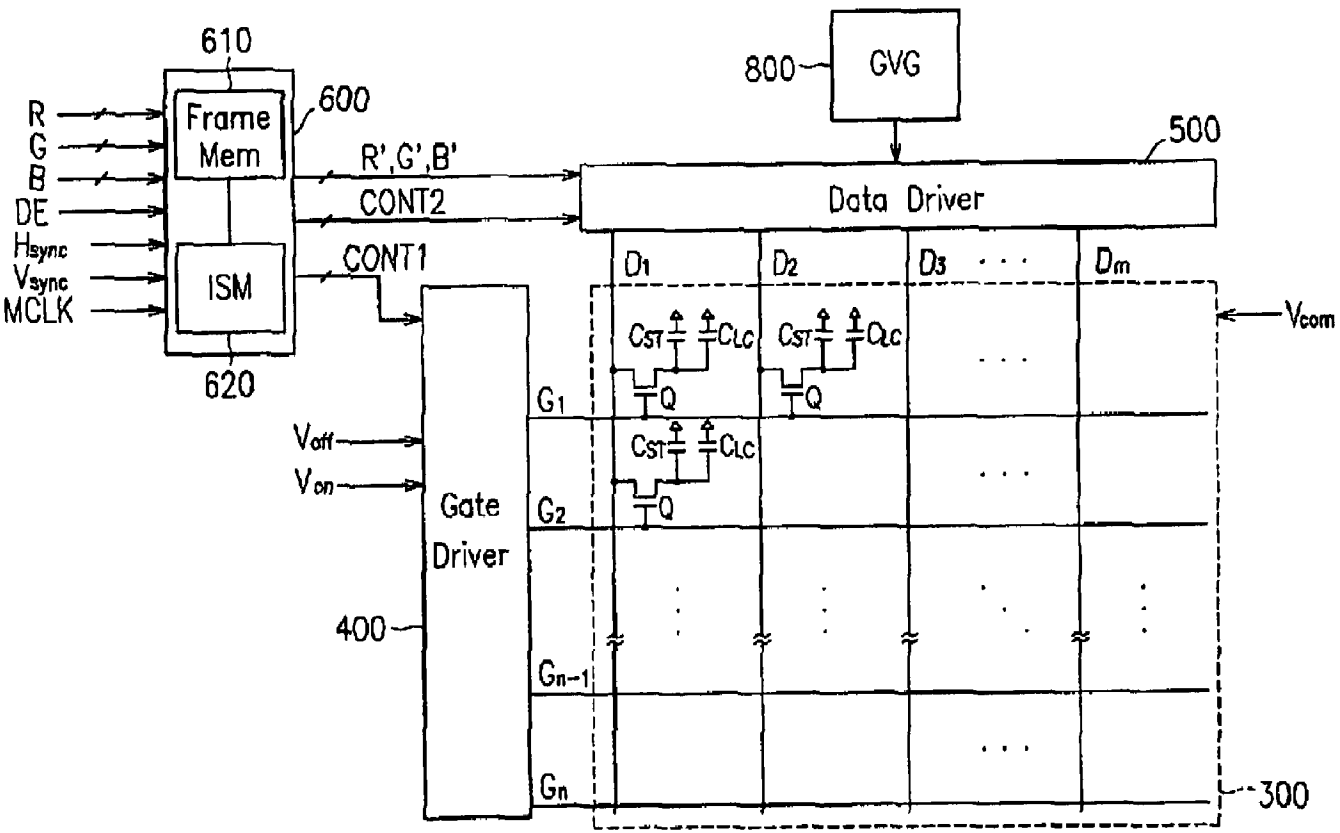
FIG. 1 is a block diagram of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, liquid crystal displays and driving apparatus and methods thereof according to embodiments of the present invention will be described with reference to the drawings.

Figure 2:
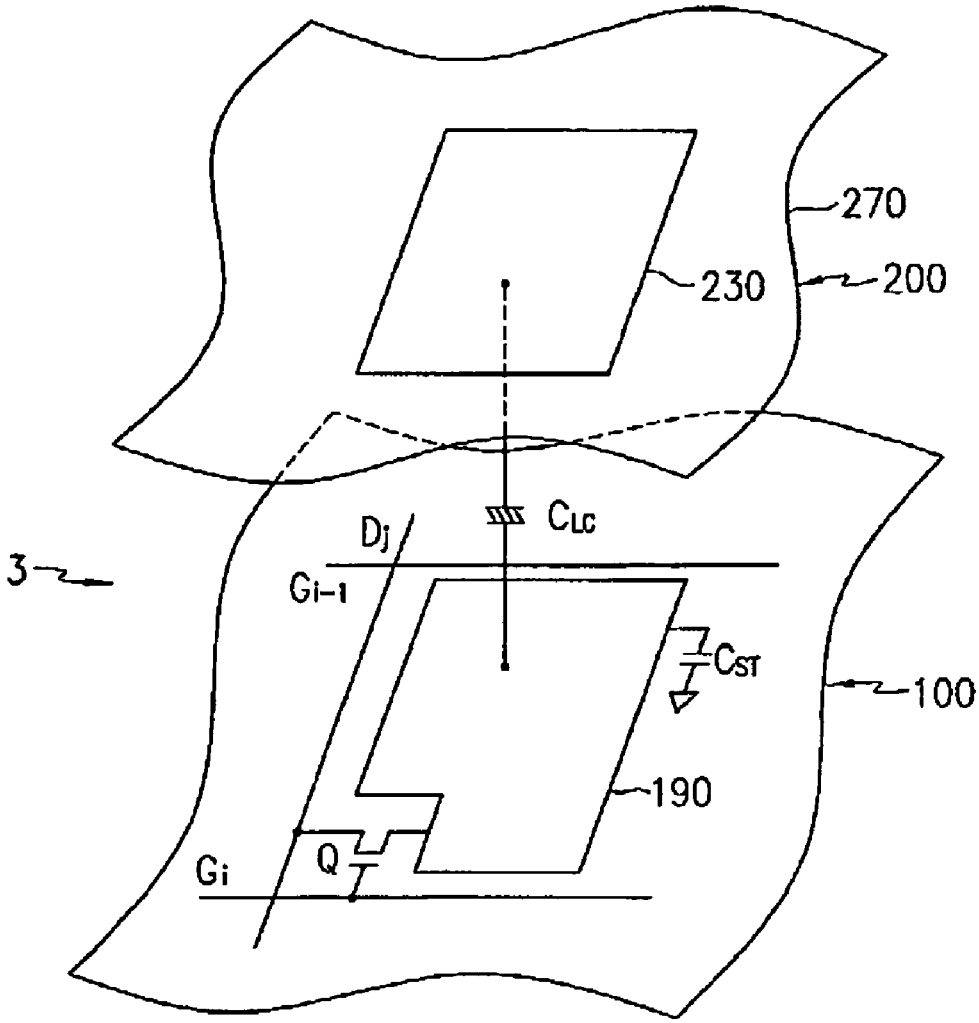
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a liquid crystal (LC) panel assembly 300, a gate driver 400 and a data driver 500 which are connected to the panel assembly 300, a gray voltage generator 800 connected to the data driver 500, and a signal controller 600 controlling the above elements.

As shown, the panel assembly 300 includes a plurality of display signal lines $G_1$-$G_n$ and $D_1$-$D_m$ and a plurality of pixels connected thereto and arranged substantially in a matrix.

The display signal lines $G_1$-$G_n$ and $D_1$-$D_m$ include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and substantially parallel to each other, while the data lines $D_1$-$D_m$ extend substantially in a column direction and substantially parallel to each other.

Each pixel includes a switching element Q connected to the signal lines $G_1$-$G_n$ and $D_1$-$D_m$, and a LC capacitor $C_{LC}$ and a storage capacitor $C_{ST}$ that are connected to the switching element Q. In some embodiments, the storage capacitor $C_{ST}$ may be omitted.

The switching element Q is provided on a lower panel 100 and has three terminals, a control terminal connected to one of the gate lines $G_1$-$G_n$, an input terminal connected to one of the data lines $D_1$-$D_m$ and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as the dielectric portion of the LC capacitor $C_{LC}$. The pixel electrode 190 is connected to the switching element Q, and the common electrode 270 is connected to the common voltage $V_{com}$ and covers entire surface of the upper panel 200. Unlike FIG. 2, the common electrode 270 may be provided on the lower panel 100. Either or both electrodes 190 and 270 may be shaped into bars or stripes.

The storage capacitor $C_{ST}$ is defined by the overlap of the pixel electrode 190 and a separate wire (not shown) provided on the lower panel 100, to which a predetermined voltage, such as the common voltage $V_{com}$, is applied. Otherwise, the storage capacitor is defined by the pixel electrode 190 and its previous gate line $G_{i-1}$ sandwiching an insulating layer.

For color display, each pixel can represent its own color by providing one of a plurality of red, green and blue color filters 230 in an area corresponding to the pixel electrode 190. The color filter 230 shown in FIG. 2 is provided in the corresponding area of the upper panel 200. Alternatively, the color filters 230 are provided on or under the pixel electrode 190 on the lower panel 100.

Referring to FIG. 1 again, the gray voltage generator 800 generates two sets of a plurality of gray voltages related to the transmittance of the pixels. The gray voltages in one set have a positive polarity with respect to the common voltage $V_{com}$, while those in the other set have a negative polarity with respect to the common voltage $V_{com}$.

The gate driver 400 is connected to the gate lines $G_1$-$G_n$ of the panel assembly 300 and applies gate signals from an external device to the gate lines $G_1$-$G_n$, each gate signal being a combination of a gate-on voltage $V_{on}$ and a gate-off voltage $V_{off}$.

The data driver 500 is connected to the data lines $D_1$-$D_m$ of the panel assembly 300 and selects gray voltages from the gray voltage generator 800 to apply as data signals to the data lines $D_1$-$D_m$. The data voltages are applied to the pixel electrodes 190 of the LC capacitors $C_{LC}$ through the switching elements Q, and the difference between the data voltage and the common voltage $V_{com}$ is expressed as a charged voltage of the LC capacitors $C_{LC}$, i.e., a pixel voltage. As used herein, "data voltage" is used interchangeably with "pixel voltage" with respect to the $V_{com}$.

The LC molecules in the LC capacitor $C_{LC}$ have orientations depending on the magnitude of the pixel voltage, and the molecular orientations determine the polarization of light passing through the LC layer 3. A polarizer or polarizers (not shown) attached to at least one of the panels 100 and 200 convert the light polarization into the light transmittance.

According to this embodiment of the present invention, the range of the gray voltages generated by the gray voltage generator 800 is wider than the range of the target pixel voltages that are reached to obtain the desired transmittance. With this larger voltage range, the pixel voltage reaches the target voltage while the switching elements are turned on, even when the gray level is changed from a black gray or a middle gray into a white gray, or from the white gray or the middle gray into the black gray.

The upper limit of the gray voltage is preferably higher than the upper limit of the target pixel voltages and the lower limit of the gray voltages is preferably lower than the lower limit of the target pixel voltage. In an alternative embodiment, the upper limit of the gray voltage is higher than the upper limit of the target pixel voltage, while the lower limit of the gray voltage is substantially equal to the lower limit of the target pixel voltage. In yet another embodiment, the lower limit of the gray voltage is lower than the lower limit of the target pixel voltage, while the upper limit of the gray voltage is substantially equal to the upper limit of the target pixel voltage. Usually, the gray voltage range encompasses the pixel voltage range.

For an exemplary normally black LCD having 256 gray voltages, the gray voltages for the 41-th gray to the 210-th gray are in a range between about 1V and about 4.5V, which is the same as the pixel voltages, while the gray voltages for the 0-th gray to the 40-th gray and the 211-th gray to the 255-th gray are in a range from about 0V to about 1V and in a range from about 4.5V to about 6V, respectively.

For another exemplary LCD having 256 gray voltages, the gray voltages for the 0-th gray to the 210-th gray are in a range between about 1V and about 4.5V, which is the same as the pixel voltages, while the gray voltages for the 211-th gray to the 255-th gray are in a range from about 4.5V to about 6V. For 64 gray voltages, the gray voltages for the 0-th gray to the 56-th gray are in a range equal to that of the pixel voltages, while the gray voltages for the 57-th gray to the 64-th gray is larger than them.

The signal controller 600 includes a frame memory 610 and an image signal modifier 620 connected to the frame memory 610. Alternatively, the image signal modifier 620 is provided as a stand-alone device separated from the signal controller 600.

The signal controller 600 receives RGB image signals R, G and B from an external graphic controller (not shown). The signal controller 600 also receives input control signals controlling the display thereof, for example, a vertical synchronization signal $V_{sync}$, a horizontal synchronization signal $H_{sync}$, a main clock MCLK, a data enable signal DE, etc. The signals controller 600 generates a plurality of gate control signals CONT1 and a plurality of data control signals CONT2 on the basis of the input control signals and provides the gate control signals CONT1 for the gate driver 400 and the data control signals CONT2 for the data driver 500. Moreover, the image signal modifier 620 of the signal controller 600 modifies the image signals R, G and B based on the gray differences between the image signals for a previous frame and for a current frame, and provides the modified image signals R', G' and B' for the data driver 500. The modification of the image signal modifier 620 will be described later in detail.

The gate control signals CONT1 include a vertical synchronization start signal STV that indicates the beginning of a frame, a gate clock signal CPV for controlling the output time of the gate-on voltage $V_{on}$ and an output enable signal OE for defining the widths of the gate-on voltage $V_{on}$. The data control signals CONT2 include a horizontal synchronization start signal STH to indicate the beginning of a horizontal period, a load signal LOAD or TP for instructing to apply the appropriate data voltages to the data lines $D_1$-$D_m$, an inversion control signal RVS for reversing the polarity of the data voltages (with respect to the common voltage $V_{com}$), and a data clock signal HCLK.

The data driver 500 receives a packet of the image data R', G' and B' for a pixel row from the signal controller 600 and converts the image data R', G' and B' into analog data voltages selected from the gray voltages from the gray voltage generator 570 in response to the data control signals CONT2 from the signal controller 600.

Responsive to the gate control signals CONT1 from the signal controller 600, the gate driver 400 applies the gate-on voltage $V_{on}$ to the gate line $G_1$-$G_n$, thereby turning on the switching elements Q connected thereto.

The data driver 500 applies the data voltages to the corresponding data lines $D_1$-$D_m$ during a turn-on time of the switching elements Q due to the application of the gate line $G_1$-$G_n$ connected thereto (which is called "one horizontal period" or "1H" and equals to one period of the horizontal synchronization signal $H_{sync}$, the data enable signal DE, and the gate clock signal CPV). Then, the data voltages in turn are supplied to the corresponding pixels via the turned-on switching elements Q.

By repeating this procedure, all gate lines $G_1$-$G_n$ are sequentially supplied with the gate-on voltage $V_{on}$ during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame is reversed (which is called "line inversion"), or the polarity of the data voltages in one packet is reversed (which is called "dot inversion").

Next, the modification of image data based on the gray difference between the image data of a previous frame and of a current frame according to an embodiment of the present invention will be described in detail with reference to FIGS. 1 and 3.

Figure 3:
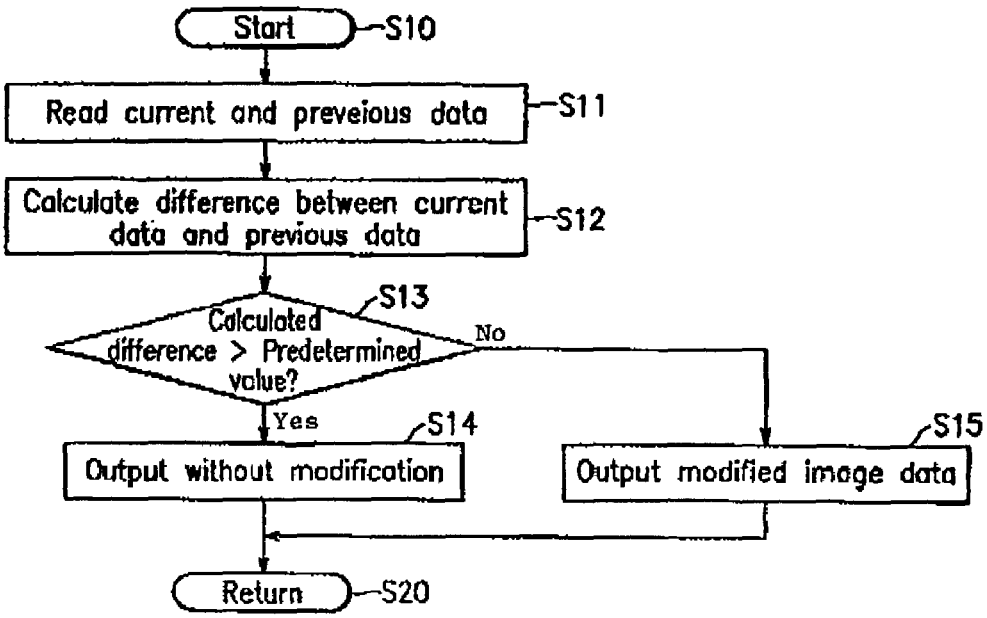
FIG. 3 is a flow chart showing the operation of an image signal modifier according to an embodiment of the present invention.

FIG. 3 is a flow chart showing the operation of the image signal modifier according to an embodiment of the present invention.

Image data R, G and B for one frame are sequentially input to the frame memory 610 and the image signal modifier 620. The frame memory 610 stores the input image data R, G and B therein. The image signal modifier 620 reads out image data R, G and B for a previous frame (referred to as "previous data" hereinafter), which have been already stored in the frame memory 610 as well as the input image data R, G and B for a current frame (referred to as "current data" hereinafter).

The image signal modifier 620 calculates the gray difference between the current data and the previous data and compares the calculated gray difference with a predetermined value (S12 and S13).

In the step S13, when the gray difference is larger than the predetermined value, the image signal modifier 620 determines that the gray difference is large and that the pixel related to the image data displays a motion image. Then, the image signal modifier 620 outputs the current image data R, G, and B without any modification (S14). The current data may be subjected to DCC based on the difference between the current image data and the previous image data, for example by the image signal modifier 620 or the signal controller 600. In one embodiment, if the current image data is higher than the previous data, a voltage larger than the target voltage is applied to the pixel electrode 190. On the other hand, if the current image data is lower than the previous data, a voltage that is less than the target voltage is applied. Generally, the larger the difference between the current data and the previous data, the larger is the difference between the current image data and the previous image data.

In the step S13, when the gray difference between the current image data and the previous image data is equal to or less than the predetermined value, the image signal modifier 620 determines that the gray difference is negligible and the related pixel displays a still image. Then, the image signal modifier 620 of the image signal controller 600 modifies the current image data R, G and B and outputs the modified image data R', G' and B' (S15).

The above-described image signal modification is based on some rules.

As described above, the range of gray voltage generated by the gray voltage generator 800 according to an embodiment of the present invention is wider than, and typically encompasses, the pixel voltage that is required for obtaining the target transmittance.

For the pixels displaying motion images, the full range of the gray voltage may be used without modification of image signals. However, the image signals for the pixels displaying still images are confined to a narrower range, such as a gray voltage range having values substantially close to the pixel voltages. When the pixels display moving images, that is, when the difference between the current image data and the previous image data is large, it takes a longer period of time to reach the target voltage than when the image being displayed is a still image. Thus, to reduce the amount of time needed to reach the target voltage, the data driver 500 applies gray voltages that are higher (or lower, depending on the polarity) than the target pixel voltages. In contrast, when the image being displayed is a still image, application of a voltage that is substantially similar to the target voltage can bring the pixels to the target voltage within the limited time. The time to reach the target voltages for the pixels displaying still images is not long because the difference between the previous image data and the current image data is small.

In one embodiment, the 41-st to the 210-th gray voltages among 256 gray voltages are in a range from 1 V to 4.5 V, which is the same as the range of the pixel voltages, and the 0-th to the 40-th gray voltages and the 211-th to the 255-th gray voltages range from 0 V to 1 V and from 4.5 V to 6 V, respectively, as described above (for positive polarity). Since the image data for the pixels displaying motion images are not modified, all gray voltages, i.e., the 0-th to the 255-th gray voltages, may be used to display the moving image. However, the pixels displaying still images use only the 41-th to the 210-th gray voltages.

In another embodiment, the 0-th to the 210-th gray voltages among the 256 gray voltages are in a range from 1 V to 4.5 V, which is equal to the range of the pixel voltages, and the 211-th to the 255-th grays ranging from 4.5 V to 6 V. In this case, the moving images may use all the gray voltages, i.e., the 0-th to the 255-th gray voltages, while the still images use only the 0-th to the 210-th gray voltages. Since the transition to a black gray requires a comparatively short charging time of the pixel voltages relative to the transition to a white gray, the target voltages are usually obtained in a given time with applied voltages that are substantially equal to the target pixel voltages.

For the latter embodiment, the 0-th to the 255-th gray voltages may be made useful for displaying still images, as described below.

The modification of image data for the still-image pixels includes mapping of the 0-th to the 255-th grays into the 0-th to the 210-th grays. For example, the 0-th gray is mapped into itself, i.e., the 0-th gray, while the 255-th gray is mapped into the 210-th gray. The grays between the 0-th gray and the 255-th gray are mapped into the grays between the 0-th grays to the 210-th grays on the basis of a predetermined pattern or methodology. The image signal modifier 620 may use a memory or a lookup table storing the mapping information for the 0-th to the 255-th grays into the 0-th to the 210-th grays. The mapping information may be provided in the lookup table, or in some other way, for easy and fast modification. Alternatively, a separate calculator for calculating modified grays is provided at the image signal modifier 620.

The mapping does not give one-to-one correspondence. For example, it is assumed that the 0-th to the 255-th grays are linearly mapped into the 0-th to the 210-th grays. That is, the x'-th gray for modified data for the x-th gray for input data is given by the relation $x'=x\times210/255$. The gray of the modified data for the 20-th gray is $20\times210/255=16.47\ldots$. An example of representing 16.47 . . . in 8-bit binary system drops all digits to the right of the decimal point and converts only 16 into "00010000."

However, since the drop of the digits after the decimal point results in exact representation of the grays, a spatial dithering and/or a temporal FRC (frame rate control) is used. The dithering represents the digits after the decimal point as an average gray of spatially adjacent pixels, while the FRC represents the digits after the decimal point as a temporally-averaged gray of a pixel.

The appropriate approximation of all the digits after the decimal point into some digits saves time and space. Accordingly, one bit, two bits or more are added to 8 bits representing the digits before the decimal point. For example, it is assumed that y represents the digits after the decimal point. The y satisfying $0\leqq y<0.25$ is approximated to 0, and y satisfying $0.25\leqq y<0.5$ is approximated to 0.25. In addition, if $0.5\leqq y<0.75$, y is approximated to 0.5, while y is approximated into 0.75 if $0.75\leqq y<1$. Each approximation is represented into 2-bit digital value. For example, 0, 0.25, 0.5 and 0.75 are represented as "00," "01," "10" and "11," respectively. Then, the mapped number 16.47 of the 20-th gray is represented as "0001000010."

Figure 4:
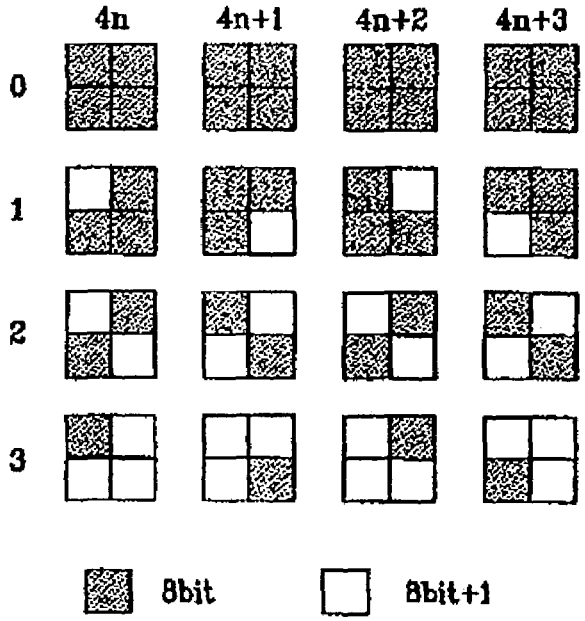
FIG. 4 illustrates a method for representing 10-bit data as 8-bit data according to an embodiment of the present invention.

An example to calculate 8-bits modified data to each pixel by using 10-bits data modified based on the above manner is shown in FIG. 4.

FIG. 4 illustrates a method for representing 10-bit data as 8-bit modified data according to an embodiment of the present invention.

Referring to FIG. 4, when lower two bits are "00," which is represented as 0 (zero) in the decimal system, all adjacent four pixels are supplied with upper 8-bit data. Since "01" corresponds to 0.25=¼ in the decimal system, three pixels among adjacent four pixels are supplied with upper 8-bit data while one pixel is supplied with the upper 8-bit data plus one. Therefore, the part right to the decimal point of the applied data averaged over the four pixels is 0.25. Similarly, when the lower two bits are "10" and "11," respectively, two pixels and one pixel among adjacent four pixels are supplied with upper 8-bit data, respectively, and remaining two pixels and three pixels are supplied with the upper 8-bit data plus one, respectively. A technique for representing the digits after the decimal point in space, such as in the manner described above, is called "dithering."

A prolonged application of a voltage to one pixel may result in a flicker, which degrades image quality. To decrease the flicker, the digits after the decimal point are represented by data for a pixel averaged in frame, and this technique is herein referred to as "FRC."

FIG. 4 shows a data assignment for a 2×2 pixel matrix under the dithering and the FRC for four sequential frames, i.e., the 4n-th, the (4n+1)-th, the (4n+2)-th and the (4n+3)-th frames.

Figure 5A:
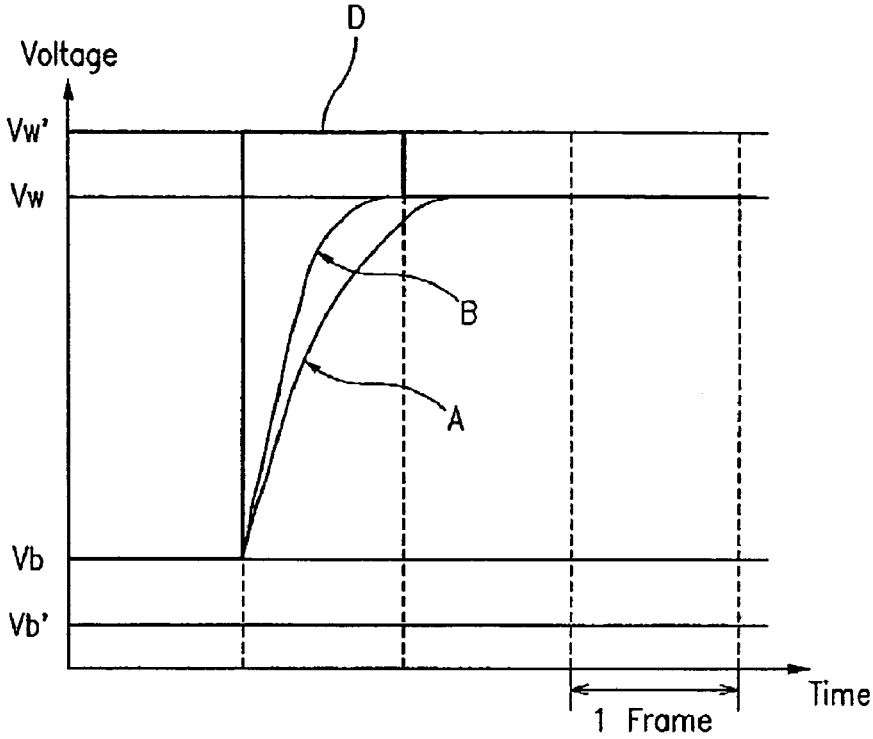
FIG. 5A is a graph showing pixel voltages as function of time when a previous data is a black gray and a current data is a white gray.
Figure 5B:
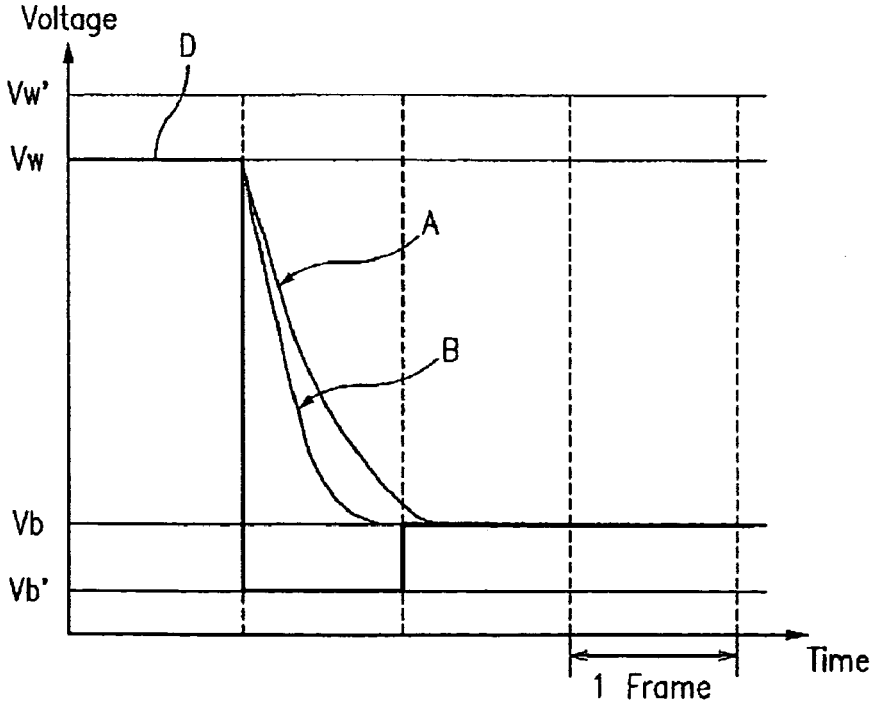
FIG. 5B is a graph showing pixel voltages as function of time when a previous data is a white gray and a current data is a black gray.

Next, referring to FIGS. 5A and 5B, the charging time of an LC capacitor according to an embodiment of the present invention is described in detail.

FIG. 5A is a graph illustrating pixel voltages as function of time when a previous data is a black gray and a current data is a white gray, and FIG. 5B is a graph illustrating pixel voltages as function of time when a previous data is a white gray and a current data is a black gray.

In FIGS. 5A and 5B, Vb and Vw are a black pixel voltage value and a white pixel voltage value, respectively, and Vb' and Vw' are gray voltage values for the black gray and the white gray according to an embodiment of the present invention, respectively.

Moreover, a curve A represents a pixel voltage of a pixel supplied with a data voltage having the target pixel voltage values Vw and Vb, and a curve B represents a pixel voltage of a pixel supplied with a data voltage D having values Vw' and Vb' higher and lower than the target pixel voltage values Vw and Vb, respectively, according to this embodiment of the present invention.

As shown in FIGS. 5A and 5B, the charging time of the LC capacitor displaying motion pictures is accelerated such that the pixel reaches the target pixel voltage values for a given period.

According to this embodiment of the present invention, the range of gray voltages is wider than that of the target pixel voltages and the available range of the gray varies depending on the difference of the image data in between a current frame and a previous frame. The image data for a pixel displaying a still image is modified such that a data voltage equal to the a target pixel voltage is applied to the pixel, while a pixel displaying motion images is supplied with a data voltage larger or less than a target pixel voltage, the data voltage selected from the entire gray voltages, thereby accelerating the charging time of the LC capacitor of the pixel to make the pixel voltage reach the target pixel voltage for a given period. In particular, this is applied to the entire grays including a black gray and a white gray to improve the charging time of the LC capacitors.

Although several embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A device for driving a liquid crystal display, the device comprising:

a gray voltage generator to generate a plurality of gray voltages corresponding to input gray values, wherein a gray voltage range is wider than a target pixel voltage range;

an image signal processor to process a current image data on the basis of a difference between the current image data and a previous image data; and a data driver to apply a first gray voltage selected from a first gray voltage range when the current image data relates to a motion image or a second gray voltage selected from a second gray voltage range when the current image data relates to a still image to the pixel, based on the processed current image data, wherein the first gray voltage range is the same as the gray voltage range and the second gray voltage range is different from and included in the first gray voltage range, the processed current image data having a number of gray values that is smaller than the number of input gray values when the current image data relates to the still image.

2. The device of claim 1, wherein the minimum value in the second gray voltage range is larger than the minimum value of the first gray voltage range.

3. The device of claim 2, wherein the minimum value of the first gray voltage range corresponds to a black gray level or a white gray level.

4. The device of claim 1, wherein the maximum value in the second gray voltage range is smaller than the maximum value of the first gray voltage range.

5. The device of claim 4, wherein the maximum value of the first gray voltage range corresponds to a white gray level or a black gray level.

6. The device of claim 4, wherein the image signal processor outputs the current image data to the data driver as the processed current image data when a type of the current image data is a motion image, and modifies the current image data to output the modified image data to the data driver as the processed current image data when the type of the current image data is a still image.

7. The device of claim 6, wherein the modified input data is data generated by the bit extension and a frame rate control (FRC) methodology.

8. The device of claim 6, wherein the modified image data has a higher or a lower gray level than the current image data.

9. The device of claim 1, wherein the processed current image data has a number of gray values substantially the same as the number of input gray values when the current image data relates to the motion image.

* * * * *